US008709176B1

(12) United States Patent
DellaCorte

(10) Patent No.: US 8,709,176 B1
(45) Date of Patent: Apr. 29, 2014

(54) PRESTRESSING SHOCK RESISTANT MECHANICAL COMPONENTS AND MECHANISMS MADE FROM HARD, SUPERELASTIC MATERIALS

(75) Inventor: Christopher DellaCorte, Medina, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 13/246,440

(22) Filed: Sep. 27, 2011

Related U.S. Application Data

(63) Continuation-in-part of application No. 12/894,444, filed on Sep. 30, 2010.

(51) Int. Cl.
*C22F 1/18* (2006.01)

(52) U.S. Cl.
USPC ..... 148/402; 148/508

(58) Field of Classification Search
CPC ..... C21D 2201/01; C22F 1/18; F05C 2201/0466; F05D 2230/21
USPC ..... 148/402, 508
See application file for complete search history.

(56) References Cited

U.S. PATENT DOCUMENTS

| | | | | |
|---|---|---|---|---|
| 3,174,851 | A | 3/1965 | Buchler et al. | |
| 4,324,441 | A | 4/1982 | Rouverol et al. | |
| 4,865,663 | A * | 9/1989 | Tuominen et al. | 148/402 |
| 6,254,458 | B1 | 7/2001 | Julien | |
| 6,422,010 | B1 | 7/2002 | Julien | |
| 6,454,016 | B1 | 9/2002 | Julien | |
| 6,615,702 | B1 | 9/2003 | Julien | |
| 6,886,986 | B1 | 5/2005 | Julien | |
| 7,005,018 | B2 | 2/2006 | Julien | |
| 7,637,669 | B2 | 12/2009 | Glueck | |
| 7,658,547 | B2 | 2/2010 | Glueck | |
| 2010/0057381 | A1 * | 3/2010 | Pardoen et al. | 702/42 |

OTHER PUBLICATIONS

Chen et al. "Compressive superelastic behavior of a NiTi shape memory alloy at strain rates of 0.001-750 s-1". International Journal of Solids and Structures. vol. 38, Issues 50-51, Dec. 2001, pp. 8989-8998.*

* cited by examiner

*Primary Examiner* — Keith Walker
*Assistant Examiner* — Alexander Polyansky
(74) *Attorney, Agent, or Firm* — Robert H. Earp, III

(57) ABSTRACT

A method and an apparatus confer full superelastic properties to the active surface of a mechanical component constructed of a superelastic material prior to service. A compressive load is applied to the active surface of the mechanical component followed by removing the compressive load from the active surface whereby substantially all load strain is recoverable after applying and removing of subsequent compressive loads.

9 Claims, 5 Drawing Sheets

PRESTRESSING SHOCK RESISTANT MECHANICAL COMPONENTS AND MECHANISMS MADE FROM HARD, SUPERELASTIC MATERIALS

CROSS-REFERENCE TO RELATED APPLICATIONS

This application is a Continuation-in-Part of U.S. patent application Ser. No. 12/894,444 entitled MECHANICAL COMPONENTS FROM HIGHLY RECOVERABLE, LOW APPARENT MODULUS MATERIALS filed on, Sep. 30, 2010 and which is hereby expressly incorporated herein by reference.

STATEMENT REGARDING FEDERALLY SPONSORED RESEARCH OR DEVELOPMENT

The embodiment described herein was made by an employee of the United States Government and may be manufactured and used by or for the Government for Government purposes without the payment of any royalties thereon or therefore.

TECHNICAL FIELD

The present embodiment relates to the use of superelastic alloys in gears and ball bearings, and most specifically relates to prestressing of surfaces of ball bearings, bearing races, and surfaces of gear teeth so as to maximize resistance to transient overloads.

BACKGROUND

Materials for high performance bearings, gears and other mechanical components require specific properties and characteristics, including but not limited to high strength and hardness, high thermal conductivity, electrical conductivity, nonmagnetic properties and the ability to be manufactured to high dimensional tolerances and surface finish. In addition, excellent corrosion resistance and good tribological properties are important, especially for applications in extreme environments.

In rotorcraft, for instance, engine bearings, rotor mechanisms and drive systems are obvious examples where improved corrosion resistance of ball bearings and gears is a benefit. Flight and water vehicles exposed to marine environments are also prone to corrosion related failures despite the widespread use of lubricants with corrosion inhibitors. Even spaceflight hardware destined to operate in the vacuum of space, beyond the realm of atmospheric corrosion, often must be stored for extended periods before launch, and can be subject to corrosion problems. In select applications involving electric machines and sensitive instrumentation, good electrical conductivity and nonmagnetic properties can also be highly desirable. Unfortunately, no currently deployed material possesses all of these properties.

SUMMARY OF THE INVENTION

The present innovation is a method and an apparatus for conferring full superelastic properties to the active surface of a mechanical component constructed of a superelastic material prior to service. The method comprises the steps of applying a compressive load to the active surface of the mechanical component followed by removing the compressive load from the active surface whereby substantially all load strain is recoverable after applying and removing of subsequent compressive loads.

The apparatus comprises a rotationally driven central shaft having a first axis of rotation and at least two mechanical components removably mounted onto a central shaft in spaced relationship to each other, and a rotationally driven roller having a second axis of rotation parallel to the first axis of rotation exerting a compressive load on the two mechanical components. First and second rotary drive mechanisms are included for rotating the central shaft and the roller in the same direction about the first and second axis of rotation.

BRIEF DESCRIPTION OF THE DRAWINGS

Reference will be made in detail to embodiments of the disclosure, examples of which may be illustrated in the accompanying drawing Figures. The Figures are intended to be illustrative, not limiting. Although the invention is generally described in the context of these embodiments, it should be understood that it is not intended to limit the invention to these particular embodiments.

Certain elements in selected ones of the Figures may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity. In some cases, hidden lines may be drawn as dashed lines but in other cases they may be drawn as solid lines.

Figure 1:
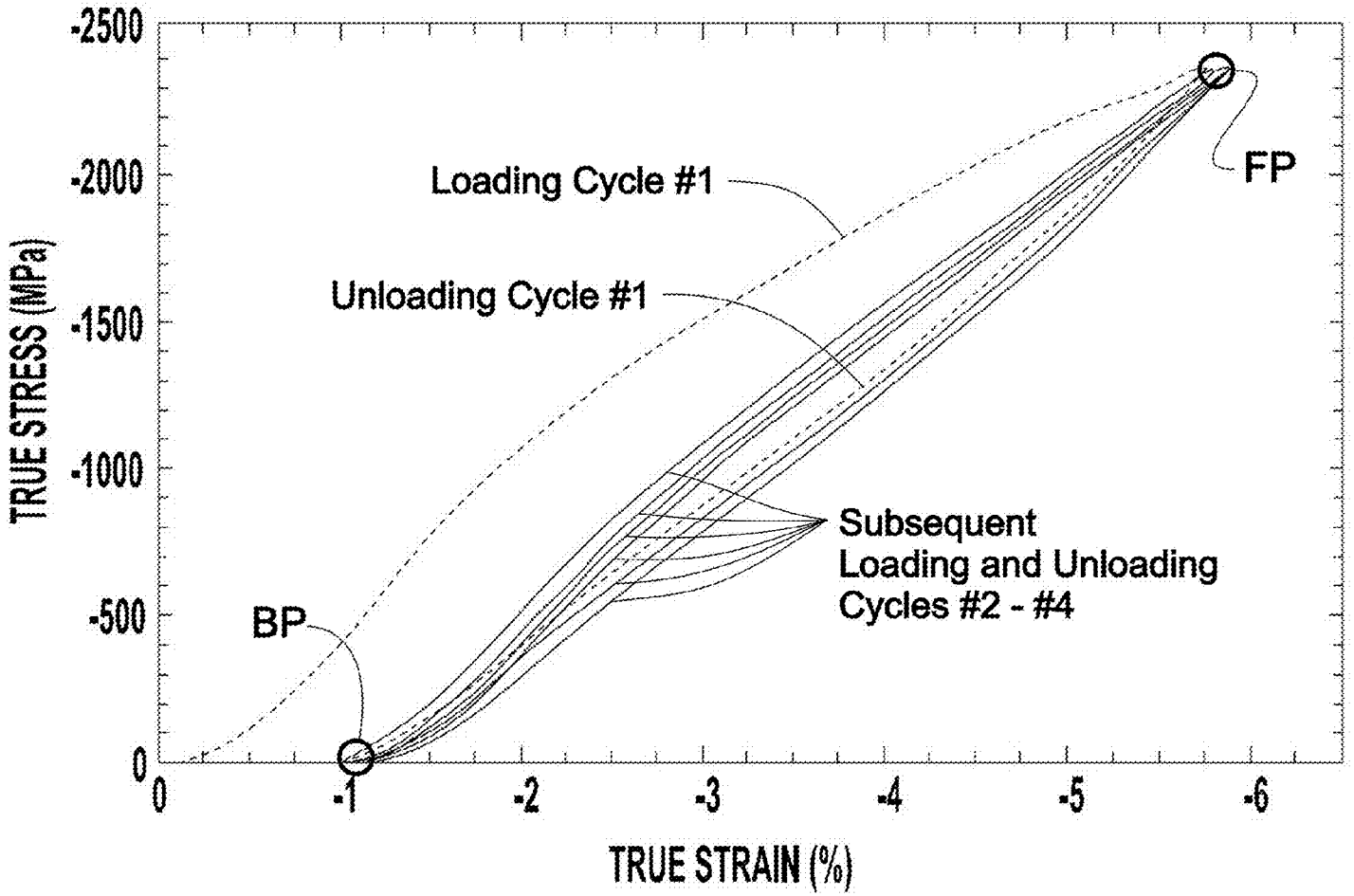

If shading or cross-hatching is used, it is intended to be of use in distinguishing one element from another. It should be understood that it is not intended to limit the disclosure due to shading or cross-hatching in the drawing Figures.

FIG. 1 is a graph showing the strain of a specimen of 60NiTi being subjected to compressive force.

Figure 2A:
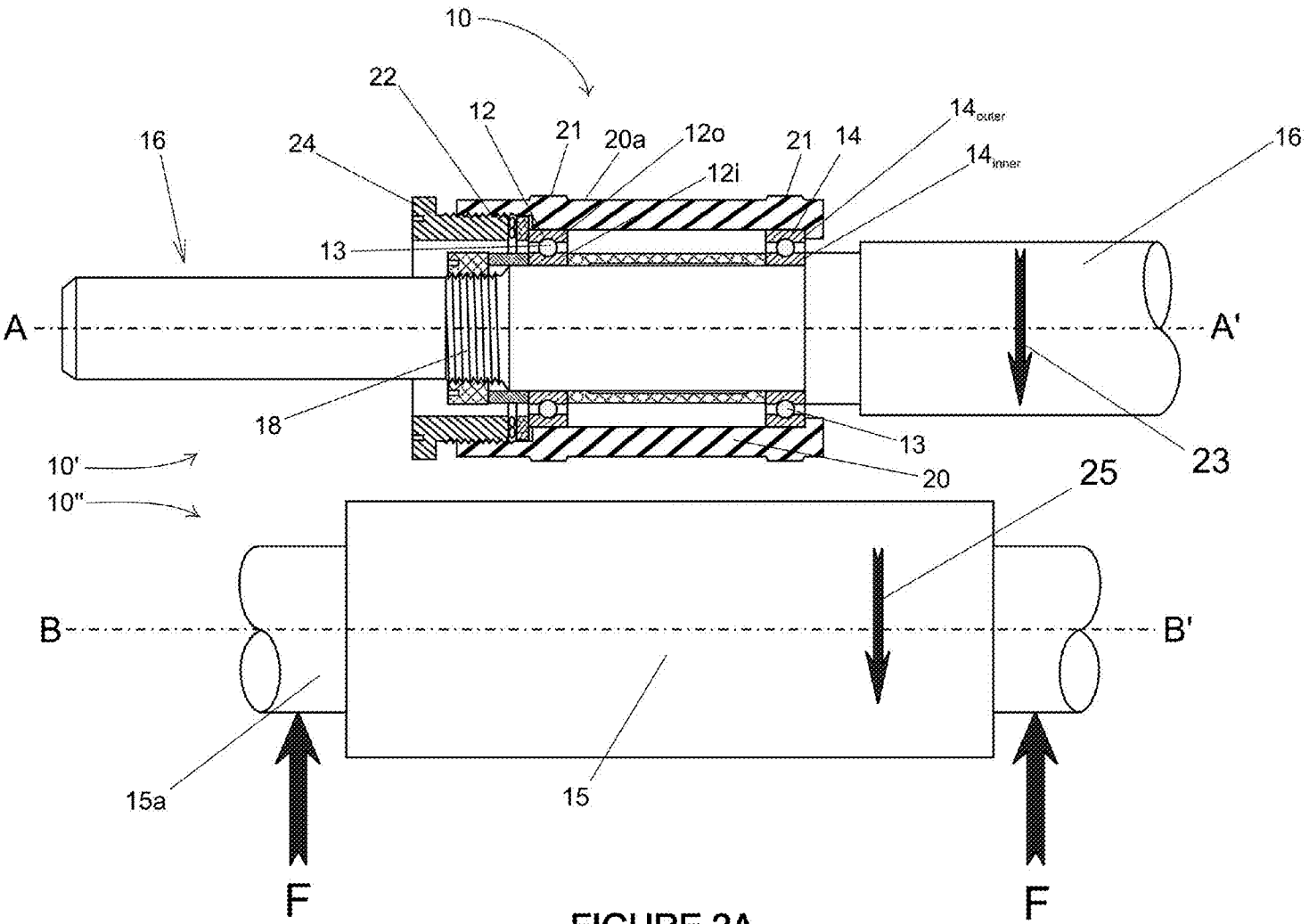

FIG. 2A is an orthogonal partial cross-sectional view of an apparatus for prestressing ball bearing raceways.

Figure 2B:
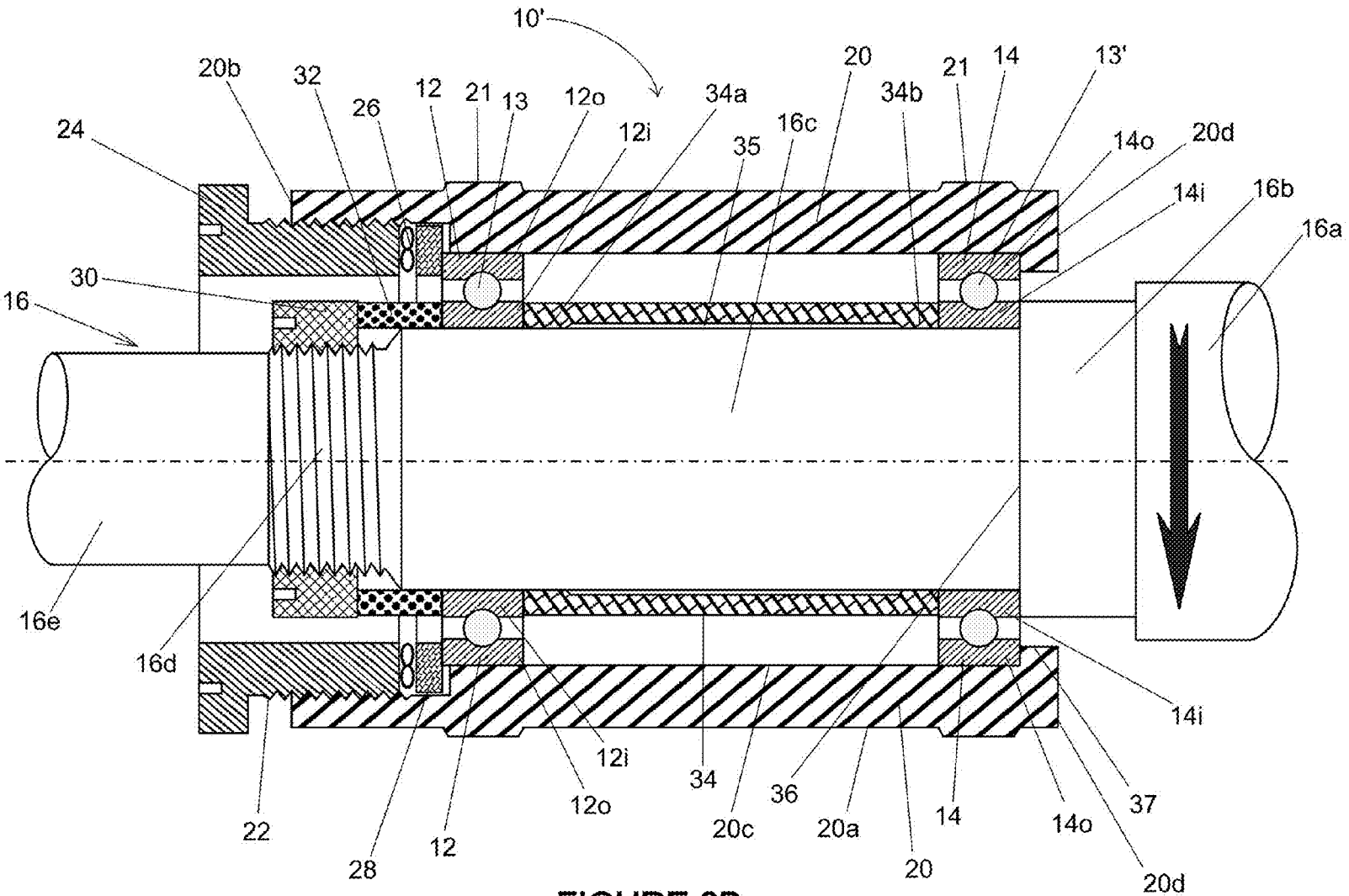

FIG. 2B is a close-up of the first part of the apparatus of FIG. 2A.

Figure 2D:
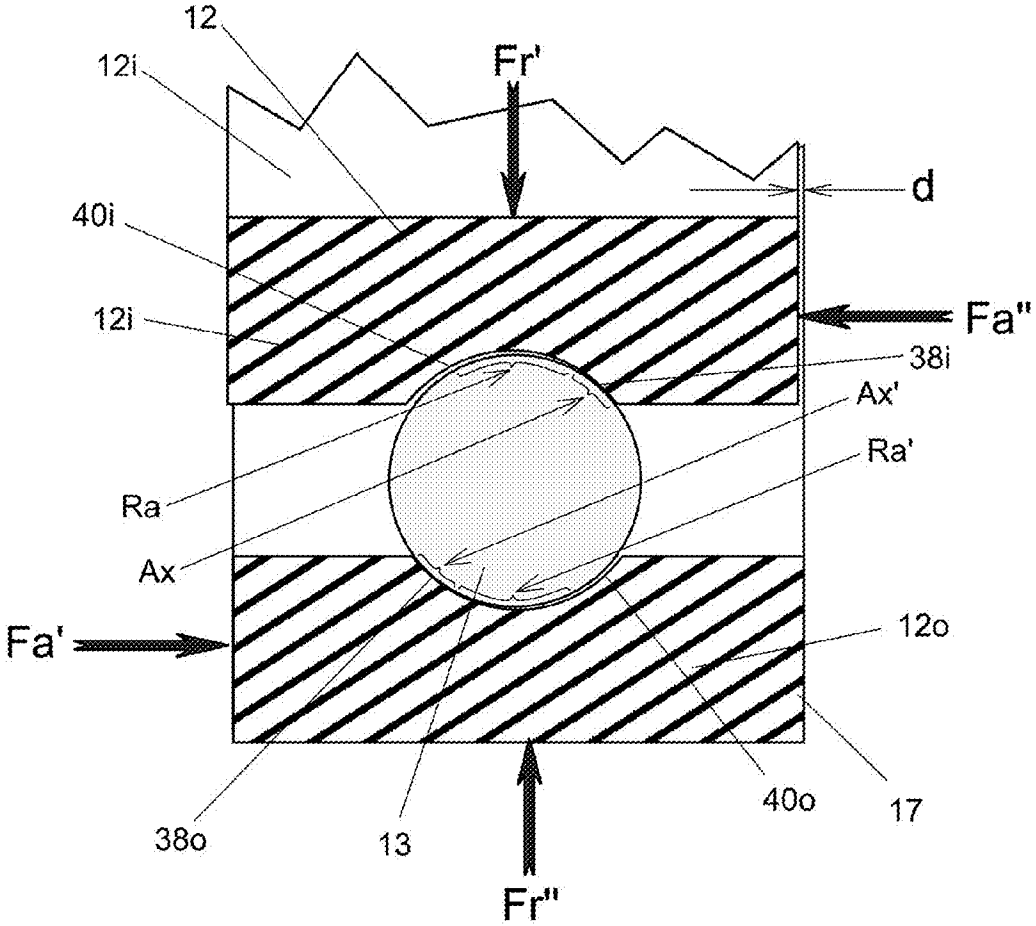
Figure 2C:
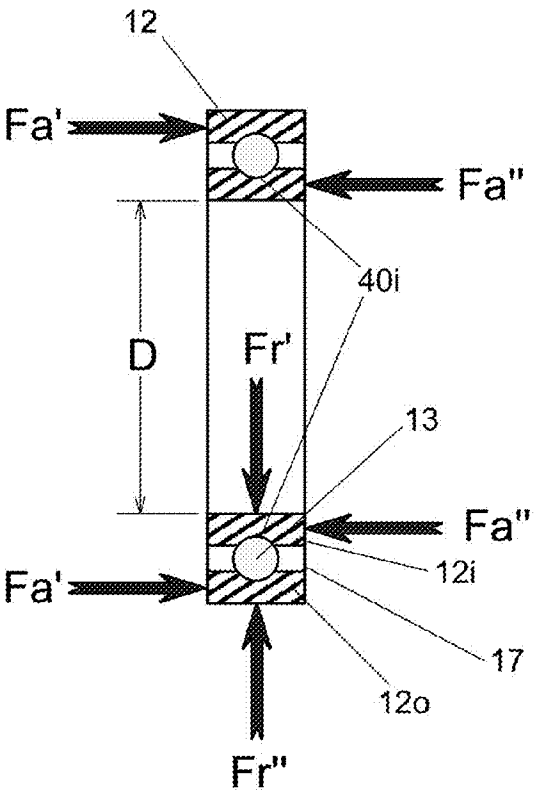

FIG. 2C is an orthogonal cross-sectional view of a ball bearing set.

FIG. 2D is a detail orthogonal cross-sectional view the ball bearing set of FIG. 2C.

Figure 3B:
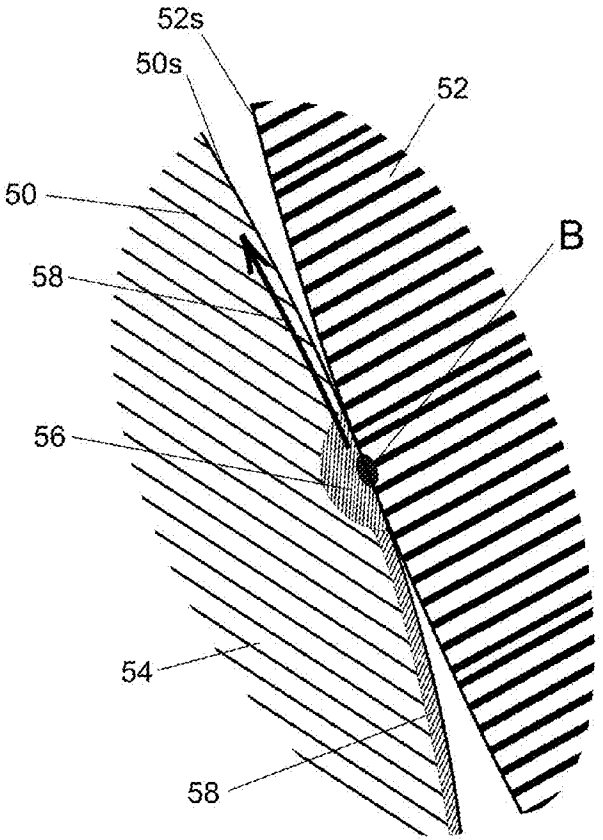
Figure 3A:
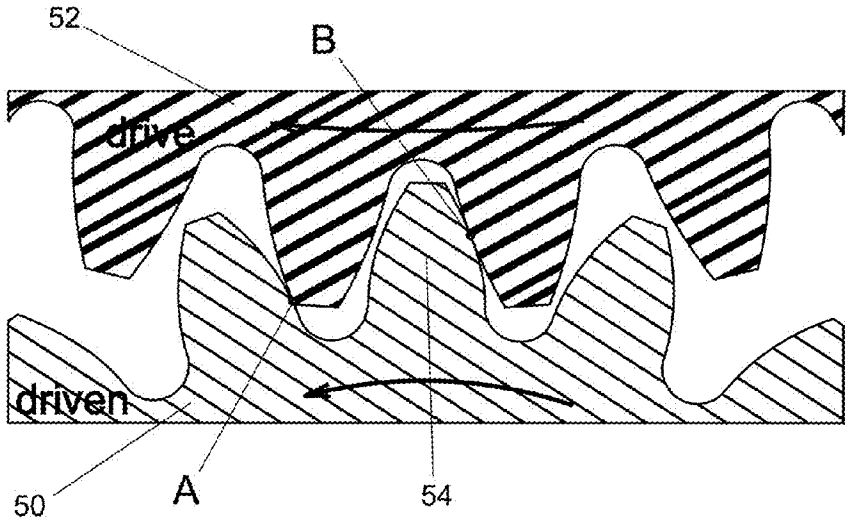

FIG. 3A is a schematic orthogonal cross-sectional view of segments of two meshing spur gears.

FIG. 3B is a detail view of one point of contact of the gears shown in FIG. 3A.

DETAILED DESCRIPTION

Mechanical components are designed to manage, transmit and support heavy loads and forces while being of minimal weight and cost and providing a long service life. Ball and roller bearings, gears, transmissions and mechanisms are prime examples of such devices. At localized contact points in such devices, e.g., where a ball contacts a bearing raceway, unexpected and uncontrollable overloads such as vibratory and shock loads often cause stresses that lead to permanent deformation such as raceway denting. Such damage can cause uneven operation and reduced service life.

The use of a class of hard, superelastic materials in the manufacture of bearings, gears and other mechanical components results in bearings, gears and the like that are corrosion proof and able to withstand excessive loads without incurring permanent damage because such materials are simultaneously strong, have relatively low stiffness, and exhibit high levels of recoverable strain. They happen also to be electrically conductive and non-magnetic.

Such a class of materials are the emerging superelastic alloys that are being applied to bearings, gears and other mechanical components can withstand heavy concentrated loads without incurring damage, provided the contact surfaces are properly and carefully prestressed in a process commonly referred to as "training," a term which is appropriated here from the shape memory alloy industry in relation to the likes of actuators and medical stents. Equivalent training methods do not exist for mechanical components. The present innovation relates to methods and apparatus for the training of hard, superelastic materials for use in the manufacture of ball and roller bearings, gears, and similar mechanical components that carry heavy loads. An example of training a superelastic material is described herein using 60NiTi, an alloy consisting of 60 weight percent nickel and 40 percent titanium having superelastic properties and which is also designated herein as Nitinol 60.

Training involves applying high forces to a component after it has been heat-treated and the majority of manufacturing has been completed. For simple shapes like wire springs and flat plates used in medical implants the training process is straightforward. But for precision components having complex surfaces, such as the smoothly ground balls, rollers, and raceway surfaces of bearings, or the profiled teeth of gear, the application of heavy training forces in a uniform and controlled manner has been a challenge. The are no current approaches to prestress superelastic surfaces having complexly curved surfaces and requiring high dimensional precision.

The conventional approach used for simple shapes is not applicable to objects having complex surfaces because the process requires that heavy, yet uniform loads be applied so that, as will be seen, permanent but controlled deformation can take place. This cannot be achieved by aggressive approaches like forging or by conventional approaches like rolling or drawing which are useful only for flat or circular shapes.

The methods put forth here are novel in several ways. First, no approach or technology exists to highly prestress contacting surfaces of high-strength precision components. Existing art involves grossly loading raw materials prior to manufacturing (e.g., forging ingots to develop improved grain structure) and lightly stressing surfaces after manufacturing is complete (e.g., shot peen blasting of gear teeth). Gentle treatments like shot-peening and glass bead blasting cannot achieve the high contact stresses required for the training of superelastic materials. Forging or other gross processes cannot be accomplished on components in their near finished geometry without the risk of undesired surface distortion. For these reasons, the disclosed approach is novel. For precision components made from superelastic materials, the challenge is to develop a means to precisely, accurately, and uniformly stress the contacting surfaces without distorting or damaging the bulk of the final component.

The present innovation consists of methods by which to apply high stress to critical surfaces of machine components (e.g., gears and ball bearing balls and raceways) made from ordered intermetallic shape memory alloys, identified as superelastic materials herein, in order to achieve maximum resilience of the finished product while retaining precise dimensions.

The ordered intermetallic shape memory alloys are selected from the group of materials including Nitinol, NiTi, NiTiXY (where X, Y could be Hf, Zr, Fe, Pd, Pt, Cu, Cr, Nb and Au), Cu-based shape memory alloys, CoNiAl, NiAl, NiMn, NiMnAl, NiMnGa, ZrCu, ZrRh, FeMn, FeMnCo, CoNiAl, CoNiGa, TaRu, NbRu and any other alloys that display shape memory behavior and having superelastic properties. The ordered intermetallic shape memory alloy is a hard material, having an austenite finish temperature (Af) below the intended use temperature of the component. The ordered intermetallic shape memory alloy has been conditioned to eliminate irrecoverable deformation in the material providing stable superelastic response.

Generally speaking, the method of the preferred embodiment put forth is to engineer convenient tooling and fixtures that mimic the final expected contact geometries, but with small and intentionally engineered geometric alterations such that critical component contacting surfaces can be subjected to high loads in a uniform manner. With this approach, the most critical contacting surfaces (e.g. the bearing raceways and gear teeth surfaces) can be "exercised" uniformly at very high loads under dynamic conditions prior to being put into service. Subsequently, when these elements experience high loads in service they will have been stressed to such a level, or even higher, during the prestress treatment, and thus will not undergo permanent damage.

In the preferred embodiment, one particular alloy is presented as exemplary of all similar ordered intermetallic shape memory alloys, that alloy being one made of nickel and titanium in, respectively, 60 and 40 weight percentage and referred to herein as Nitinol 60 and 60NiTi, those terms being synonymous.

Referring now to FIG. 1, insight can be gained into those properties under load of 60NiTi that give rise to the need for prestressing of the alloy so as to acquire full superelastic properties prior to service.

FIG. 1 is shown a stress-strain diagram of a specimen of 60NiTi subjected to compressive load uniformly distributed over its surface. Note that when a specimen that has never been previously loaded in compression is placed under load for the first time and then unloaded, i.e., Loading and Unloading Cycles #1, the resulting strain is not fully recovered, and about 1% of permanent deformation remains, as shown. Note, also, that subsequent Loading and Unloading Cycles, #2-#4, more or less traverse the same loading space between the beginning point BP and the fully loaded point FP. In other words, during subsequent loading and unloading cycles, effectively all of the load strain is recovered when the load is removed.

One can speculate on the nature of the unrecoverable portion of the strain, the compaction portion, which is evident in FIG. 1. It is the compaction aspect illustrated in FIG. 1 that embodies the prestressing or training idea. It can be said that the compaction is analogous to similar processes employed on soil underneath tall skyscraper buildings prior to construction; unless the base material is highly stressed prior to service, high loads can lead to settling. More immediately to the point here, however, is the powder metallurgical method of fabrication of superelastic parts such as those made of 60NiTi; the fact of powder metallurgy suggests that microscopic volumes having dimensions on the order of tens of nanometers up to micrometers in scale, might be caused to shrink or close up when specimens are subjected to sufficient compressive force. In other words, such volumes are residual to the powder metallurgical fabrication process. The term virtual porosity could be used to convey the concept. Another possibility is that the deformation takes place on the scale of interatomic distances, wherein compressive forces might cause atoms to rearrange more or less permanently and in ways that, plausibly, introduce intra-atomic level permanent strains that coincidentally correspond to at least slight bulk hardening of the material. Related to the innovation put forth in this application, the exact physical basis for the slight permanent deformation occurring during the first load cycle is not important, only that the loading cycle be performed before an article is placed into service under extreme loads. In this latter regard, it is worth noting that, at least in the specific case of 60NiTi, the material consists of nickel and titanium in four main phases that have been measured in the following volume percentages:

~78% B2 structured NiTi

~11% $Ni_4Ti_3$

~9% $Ni_3Ti$

~2% $Ti_2Ni$

If the permanent part of the deformation does take place at the interatomic scale, it seems reasonable to think that the partitioning of the deformation among the phases is such that one or several of the lesser or "tramp" intermetallic phases accounts for the bulk of the conjectured atomic-scale rearranging that takes place under sufficient compression loading of the sort indicated at the FP end of Loading Cycle #1 in FIG. 1.

The implications of the evidence illustrated in FIG. 1 is that the use of superelastic alloys in precision components must require that the components, or at least their surfaces, be subjected to at least one full loading cycle before being put into service, a "full loading cycle" being one that replicates in the superelastic component the effect demonstrated in FIG. 1. Without this prestressing step, the part, when in service, will be subject to a small amount of permanent deformation (i.e., dimensional change) when heavy loads are applied.

The proposed innovation is a convenient and practical method and apparatus for conferring full superelastic properties to the active surface of a mechanical component constructed of a superelastic material prior to service so as to ensure fully recoverable elastic behavior in service without resulting in uneven surfaces. In short, the method consists of applying a compressive load, in excess of the intended design load, to the active surface, but in order for the proposed method to be effective, the component must have been previously processed (machined and hardened by heat treatment) and be at or very near its final desired dimensions. This is necessary because hardened superelastic materials, because of the nature of the heat treatment and metallurgy, contain significant residual thermal stresses. Any significant machining or material removal that occurs after hardening can lead to geometrical distortions or fracture. In addition, superelastic materials typically are brittle and exhibit limited ductility so any method to exercise (i.e., prestress, train) the component must be done in a uniform manner, otherwise distortion or fracture might occur.

SPECIFIC EMBODIMENTS

In the following paragraphs the envisioned methods for prestressing (1) ball bearing races, (2) gears, and (3) spherical balls used in ball bearing sets. The term "full superelastic properties" used hereinbelow refers to the result of the prestressing treatment described here, the treatment being such as to remove from superelastic alloys used in mechanical components all unrecoverable strain of the sort described above in relation to FIG. 1 and the initial loading and unloading cycle. Subsequent strain will have been recoverable, in the way described in relation to the loading and unloading cycles 2 through 4 in relation to FIG. 1.

References herein below to "hard" materials refer to the use of such materials as tool steel and hard ceramic, the hard materials being used to prestress the mechanical components as described herein.

The term "design loading" refers to the stresses that a given mechanical component, such as a gear or bearing race, is designed to withstand when operated in the way for which it was designed.

"Active surface" herein means the surface of a mechanical component that undergoes loading during the component's intended use. For example, the active surface of a gear is the combined surfaces of the teeth where rubbing and sliding take place, and the active surface of ball bearings is the combined surfaces of the tracks of the inner and outer raceways.

The term "ordered intermetallic shape memory alloys" is identified as superelastic materials herein.

1. Ball Bearing Races

Generally speaking, the method put forth for prestressing of ball bearing raceways consists first of replacing the intended rolling elements (balls in a ball bearing) with a plurality of extremely hard balls made of tool steel or ceramic that are slightly oversized. To aid in assembly of the fixture, one may expect to use fewer than the final design number of hard balls or rolling elements. Then the bearing is operated (rotated) under a steady and heavy axial and radial loads with adequate lubrication, so as to apply a compressive load to the bearing raceway tracks with the plurality of balls rolling over the raceway tracks. The curvature of ceramic elements should be chosen to match the raceway curvature. This ensures that a good line contact is made between the race to be stressed and the hard ceramic element. Following this treatment, the oversized ceramic elements are replaced with the proper number of normal sized elements, which can be ceramic or other hard material, and the bearing is placed into service. If a heavy load is then applied to the bearing the rolling elements will contact race surface material that has been previously stressed to a high level and no permanent deformation will occur, i.e., no unrecoverable strain will take place, within the limits of the material that has been so treated.

FIGS. 2A,2B,2C,2D illustrate an apparatus 10 and methods for prestressing ball bearing races by subjecting assembled ball bearing to high loadings of two forms: axial and radial.

FIG. 2A is an orthogonal, partial cross-sectional view of an apparatus 10 for prestressing the raceways of a first ball bearing set 12 and a second ball bearing set 14. The apparatus 10 is designed to provide extreme but variable and controllable radial and axial forces upon the two bearing sets 12,14. It is envisioned that the respective inner and outer raceways (as described hereinbelow in relation to FIGS. 2C and 2D) of the first and second bearings 12,14 can be subjected to sufficient radial and axial prestressing loads if the balls 13,13' of bearings 12,14, respectively, are made of the very hard material suggested, namely, tool steel or a hard ceramic such as silicon nitride, and are slightly oversized compared to the balls that will ultimately be used in the ball bearing sets.

In FIGS. 2A and 2B, the radial portion of prestressing is achieved by moving a first generally cylindrical portion 10' of the apparatus 10 having first and second bearing sets 12,14 mounted thereon into contact with a second generally cylindrical portion 10" of the apparatus 10, and then applying a large force F against the second portion 10" so as to bring the first and second portions tightly together, as will be explained in more detail below. The first and second portions 10',10" are both rotated in such a way that, if viewed end-on, they would be seen to rotate clockwise or counterclockwise, as suggested by arrows 23 and 25.

The first portion 10' includes a rotationally driven central shaft 16 having a first axis of rotation A-A'. The central shaft 16 is mounted at a first end section 16*a* to a rotary power source (not shown). Shaft 16 includes a second section 16*b* adjacent to end section 16*a* and having a smaller diameter than the end section. Shaft 16 further includes a central section 16*c* adjacent to the second section 16*b* and having a smaller diameter than the second section to form a shoulder 36. Shaft 16 further includes a threaded section 16*d* adjacent central section 16*c*. Shaft 16 still further includes a second end section 16*e* adjacent to the threaded section 16*d*.

As shown in FIGS. 2A and 2B a distance tube 34 is disposed about the central section 16*c* between the inner races 12*i* and 14*i* of the first and second bearing sets 12,14 and functions to separate the bearing sets from each other. In addition a spacer ring 32 is disposed about the central section 16*c* and the threaded section 16*d* and engages the inner race 12*i*. A nut 30 is removably mounted onto threaded section 16*d* to press against the inner race 12*i*, the tube 34 and the inner race 14*i*.

When fully assembled, the first portion 10' includes the bearing sets 12,14 having inner races 12*i*,14*i* and outer races 12*o*,14*o*, respectively, mounted onto the central section 16*c* in spaced relation to each other. First portion 10' also includes an outer sleeve 20 with bearing sets 12,14 disposed therein with the outer races of the of the first and second ball bearing are in contact with the inner surface of the outer sleeve. The outer sleeve 20 is disposed around the central section 16*c* and the threaded section 16*d* and has a cylindrical outer surface 20*a* with two spaced raised regions 21 thereabout designed to engage a rotationally driven roller 15 rotating about a second axis of rotation B-B' of the second portion 10'. The second axis of rotation B-B' is parallel to the first axis of rotation A-A'. The outer sleeve 20 also has a threaded inner section 20*b* at one end with a larger diameter than the inner surface 20*c* into which are mounted the bearing sets 12,14. The inner surface 20*c* of the outer sleeve 20 extends from the threaded inner section 20*b* to a shoulder 37 formed by the end section 20*d* of the shoulder.

Referring again to FIGS. 2A and 2B, when fully assembled, the first portion 10' includes an outer spacer ring 28 within the threaded inner section 20*b* and in engagement with the outer race 12*o* of bearing race 12.

When the first portion 10' is fully assembled, a preload plug 24 is mounted in one end 20*b* of the outer sleeve 20 to exert opposite directed axial forces upon the outer races 12*o*,14*o* of the first and second ball bearing sets 12,14. The preload plug 24 presses upon a wave spring 26 which exerts axial force upon a spacer ring 28, which in turn presses upon the outer race 12*o* of the ball bearing set 12. As mentioned above, inner race 12*i* of the ball bearing set 12 abuts distance tube 34 which in turn abuts the inner race 14*i* of the ball bearing set 14, pushing it tight against a shoulder 36 that demarcates a boundary between shaft portions 16*b* and 16*c*. The inner races 12*i*,14*i* have inner diameters D (FIG. 2C) providing a running fit upon the central portion 16*c*. The distance tube 34 likewise has an inner diameter of D at its ends 34*a*,34*b*, with a 0.010 inch inner diametrical clearance gap 35 between the ends. A nut 30 fits upon the threaded section 16*d*. When tightened, the nut 30 presses upon a spacer 32 which conveys axial force upon the inner race 12*i* of the ball bearing set 12. The inner race 12*i* in turn presses upon the distance tube 34 which conveys axial force upon the inner race 14*i* of the ball bearing set 14, thereby pressing it against the shoulder 36 so as to secure the two inner races 12*i*,14*i* with respect to the shaft 16.

The preload system described allows the application of a controllable axial load on the bearings and is well understood by those familiar with the art. Any number of approaches can be used to apply such forces in any direction and are implied in this description.

The sequence of assembly of the first portion 10' is approximately as follows: The drive portion 16*a* of shaft 16 is disengaged from its rotational power source (not shown). Ball bearing set 14 is placed upon the central portion 16*c* of the shaft 16 and slide against the shoulder 36. Distance tube 34 is next placed on the central portion 16*c*, and slide on so as to engage the inner race 14*i* of bearing set 14. Ball bearing set 12 is then placed on the shaft portion 16*c*, followed by the spacer ring 32 and the nut 30, the latter then being tightened upon threaded section 16*d* so as to tightly secure the two inner bearing races 12*i*,14*i* upon the shaft 16. The outer sleeve 20 is then slid over the outer races 12*o*,14*o* of the two ball bearing sets 12,14. Outer sleeve 20 is slid over the outer races 12*o*,14*o* of the bearings 12,14 from the drive end 16*a* of the shaft 16 until the internal circumferential shoulder 37 engages the outer race 14*o*. The spacer ring 28 is placed inside of the threaded end 20*b* of the outer sleeve 20, followed by the wave spring 26. The preload plug 24 is next screwed into the end 20*b* of the outer sleeve 20, until the desired axial loading is placed upon the outer races 12*o*,14*o* of the ball bearing sets 12,14.

The second portion 10" of the apparatus 10 includes a roller 15 having an axis of rotation B'-B' and a first end section 15*a* connected to a rotary power source (not shown). When the second portion 10" is disposed immediately adjacent to, and pressing against, the raised regions 21 of the outer sleeve 20, force F (FIG. 2A) generated by any mechanical means (not shown) is brought to bear so as to deliver radial loading to the ball bearing sets 12,14.

The shaft 16 rotates about a first axis A-A' while the roller 15 rotates about a second axis B-B' in the same direction, clockwise or counterclockwise as viewed end-on.

Both the axial and radial portions of the prestressing are addressed in detail below.

A. Axial Prestress Loading

FIG. 2B is an expanded view of the first part 10' of the apparatus 10 shown in FIG. 2A. The first portion 10' consists of a rotationally driven central shaft 16 that rotates about a first axis of rotation A-A'. The central shaft 16 has a threaded portion 16*d*. The first portion 10' thus has at least two mechanical components, which are the ball bearing sets 12,14, removably mounted onto the central shaft 16 in spaced relation to each other, an outer sleeve 20 with threaded portion 20*b* and preload plug 24 screwed into it and applying axial loading on wave spring 26 and spacer 28 which applies axial force on the outer races or raceways 12*o* and 14*o*. It is important to note here that the outer races 12*o*,14*o* fit snugly but not tightly within the outer sleeve 20. Axial force on the outer race 12*o* is directed to the right in FIGS. 2A,2B, while axial force against the outer race 14*o* is directed to the left.

Nut 30 tightens on threads 16*d* so as to exert force upon spacer 32 which in turn conveys force to inner race 12*i* of bearing set 12 which itself bears upon distance tube 32 that conveys force to the inner race 14*i* of the bearing set 14, thrusting it tightly against the shoulder 36 of shaft 16. The net effect illustrated in FIG. 2B is that the two inner races 12*i*,14*i* are held tightly on the shaft 16 while the outer races 12*o*,14*o* are pushed axially toward one another so that each bearing set 12,14 is subjected to axial loading that is illustrated in FIGS. 2C and 2D, the axial loading being variable and controllable due to the tightening of the preload plug 24.

FIG. 2C shows the ball-bearing set 12 in orthogonal cross-sectional detail consisting of outer race 12*o*, inner race 12*i*, and balls 13. The axial force causes a force couple Fa'-Fa" to be exerted upon the bearing 12, causing the races 12*o*,12*i* to be displaced a small amount d from one another, as shown in FIG. 2D, which shows the relationships of the races with the ball 13. Note in FIG. 2D the bracketed regions denoted as Ax and Ax'. Region Ax is, in the cross-sectional view of FIG. 2D, a portion of the arc 38*i* of the ball track 40*i* of the inner raceway 12*i*. As is readily apparent to those skilled in the art, the region Ax of the ball track 40*i* extends circumferentially around the entire ball track of the raceway 12*i* and therefore is a complexly curved area that is not otherwise illustrated here. The areal region Ax is the portion of track 40*i* of the inner race 12*i* that receives the most concentrated pressure of the balls 13 upon the track as a result of the axial force couple Fa',Fa" and is therefore the portion of the track that gets subjected to the most pressure as the balls 13 roll upon it. The region designated by the bracket Ax will be wider or narrower depending upon the respective radii of curvature of the balls 13 and the track 40*i* and the magnitude of the force couple Fa',Fa". Likewise Ax' is the corresponding region of track 40*o* of the outer race 12*o*. If the respective radii of curvature of the ball tracks 40*i*,40*o* are exactly the same, then, obviously, the corresponding region Ax', as indicated by the bracket, will have the same width as Ax, and it will be close to 180 degrees away, relative to the ball 13. The two regions Ax,Ax' are meant to indicate the general circumferential areal portions of the bearing tracks 40*i*,40*o* where prestressing of the respective tracks takes place during axial loading of the bearing as the hard balls 13 roll over those tracks during axial loading. Those who are skilled in the art will be aware that bearing set 14 will be subject to similar forces, albeit mirrored with respect to bearing set 12.

Those skilled in the art will further recognize that the axial aspect of the prestressing effect of the above apparatus 10 will be limited to single sides of tracks 40*i*,40*o* of the respective bearing raceways 12*i*,12*o*,14*i*,14*o*. This means that for the entire width of each raceway to be properly prestressed, the bearing sets 12,14 will have to be removed from the apparatus 10, flipped over, and then reinstalled so that all bearing tracks will be prestressed by this process. Alternately, a similar method can be used to apply axial loads that act to separate the two bearing outer races 12*o*,14*o* (as opposed to the current arrangement of springs and bearings that act to press both bearings outer races together). To those in the art this will be readily seen as obvious.

B. Radial Prestress Loading

Referring to FIGS. 2A and 2B, radial prestress loading of the bearing sets 12,14 can be achieved by bringing the roller 15 into contact with the raised regions 21 of the outer sleeve 20 and then rotating the respective first portion 10' of the apparatus 10 against the second portion 10". As roller 15 exerts a force F (FIG. 2A) that is radial to axis A-A' of the first part 10' of the apparatus 10 upon the outer sleeve 20, a radial force can be conveyed to the bearing sets 12,14.

FIG. 2D shows the second region 17 of the ball-bearing set 12 in orthogonal cross-sectional detail consisting of outer race 12*o*, inner race 12*i*, and balls 13. Radial force couple Fr'-Fr" acts on the second portion 17 of the respective races 12*i*,12*o* of bearing 12. As should be readily apparent, the effect of the force couple Fri-Fr" is greatest near that lower region 17, i.e., the regions of the respective races 12*i*,12*o* (and 14*i*,14*o*) that are most proximal to roller 15 (FIG. 2A).

Note in FIG. 2D the bracketed regions denoted as Ra and Ra'. Region Ra is, in the cross-sectional view of FIG. 2D, a portion of the arc 38*i* of the ball track 40*i* of the inner raceway 12*i*, as indicated in FIG. 2D. Those skilled in the art will, upon momentary contemplation, agree that the bracketed region Ra of the ball track 40*i* does not extend circumferentially around the entire ball track, because the radial force couple Fr',Fr" acts only in the lower region 17 of the ball bearing set 12, but it is nonetheless a complexly curved area that is not otherwise illustrated. The region Ra is the portion of track 40*i* of the inner race 12*i* that receives the most concentrated pressure of the balls 13 upon the track as a result of the radial force couple Fr',Fr" and is therefore the portion of the track that gets subjected to the most pressure as the balls roll upon it. The region designated by the bracket Ra might be wider or narrower depending upon the respective radii of curvature of the balls 13 and the track 40*i* and the magnitude of the force couple Fr',Fr". Likewise Ra' is the corresponding region of track 40*o* of the outer race 12*o*. If the radii of curvature of the ball tracks 40*i*,40*o* are exactly the same, then the corresponding region Ra', as indicated by the bracket, will have about the same width as Ra, and it will be close to 180 degrees away, relative to the ball 13. The two bracketed regions Ra,Ra' are meant to indicate the general areal portions of the bearing tracks 40*i*,40*o* where prestressing of the respective tracks takes place during radial loading of the bearing 12. Note that the areal aspect of these regions Ra,Ra', are not likewise circumferential about the entire raceways 12*o*,12*i*, as in the case of the axial forces described hereinabove in relation to the regions Ax,Ax'. In the case of radial forces, the corresponding areas, as designated in cross sectional view of FIG. 2D by the bracketed regions Ra,Ra', extend only a short distance from the bottom-most part of the lower region 17.

As those skilled in the art will see, bearing set 14 will be subject to a similar radial force couple.

The bracket designated areal regions Ax,Ax',Ra,Ra', wherein sufficient compressive force will be delivered to the surfaces of the respective races 12*i*,12*o*,14*i*,14*o*, so as to prestress them, can be widened or narrowed or made to overlap according to the relative magnitudes of the respective axial and radial forces and the respective radii of the balls 13 and tracks 40.

2. Balls

Similarly, a ball bearing made entirely from superelastic materials could be operated under a heavy radial load while altering the axial load thusly moving the contact path of the balls over a larger region of the raceway. This type of alternate embodiment is not as controlled or precise as the method proposed above is simpler and may be sufficient in certain circumstances.

3. Gear Teeth

Similar approaches can be used for gears or, more specifically, for prestressing the surfaces of gear teeth made of superelastic alloys. Typically gears are used in sets of matching gears wherein each gear of a matched set is shaped so as to optimally mesh with the other, the net result being maximum mechanical efficiency and long service life. The contact between gear teeth is called the mesh, which is illustrated in the schematic cross-sectional view of FIG. 3A, showing a segment of a driven spur gear 50 meshing with a drive spur gear 52.

To achieve the prestressing in gears, one of the two gears, drive or driven, is replaced with a matching gear made of hard ceramic material or tool steel, the matching gear having a tooth surface geometry that will result in a uniform line of contact with the gear to be treated. The active surfaces of the gears, i.e., the gear teeth, are then lubricated and rotated under smooth but heavy load. In FIG. 3A, the driven gear 50 is presented as made of superelastic material and undergoing prestressing due to its contact with the drive gear 52 which is made of a hard material.

Two points of tooth contact are shown, at locations A and B. The points of contact A,B are shown as points in the orthogonal view of the illustration, but they are, in spur gears, actually lines of contact that extend perpendicularly into and out of the plane of the illustration. As the gears 50,52 both rotate in the directions shown by the arrows, the points A,B, being foreshortened lines of contact, sweep over each tooth, such as for point/line B on tooth 54.

The maximum load applied should correspond to maximum stresses expected in service. The point/line of contact B is shown in close-up cross-sectional view in FIG. 3B. The point/line B is not actually a point or a line because is has a finite width, due to the great pressure of the drive gear 52 acting upon the driven gear 50. A thin layer of lubricant separates the surface 50*s* of driven gear 50 from the surface 52*s* of the drive gear 52. FIG. 3A also shows a zone of maximum loaded deformation 56 adjacent the point of contact B in the driven gear 50. As the point/line of contact B moves across the surface 50*s* of gear tooth 54 of the driven gear 50, the compressive action of the contact at B results in a near-surface region 58 where the prestressing has taken place.

The inventor also contemplates that the distance between the gear rotation axes of the drive gear 52 and the driven gear 50 might possibly be altered during the prestressing operation to allow the highly stressed line contact area to traverse the entire surface of the gear teeth and thus treat a broad area.

After the prestressing treatment, the hard prestressing gear 52 is replaced with an intended companion gear (which has separately been treated). In this manner the surfaces of the gear teeth will have undergone prestressing in a uniform manner.

The inventor contemplates that the prestressing of two superelastic gears might be accomplished by using them together in a high-load configuration.

The inventor also contemplates that helical and other gear types could be treated in similar ways, though a description thereof would be more complicated than in the foregoing example involving spur gears.

ALTERNATIVE EMBODIMENTS

While the innovation proposed herein involves the prestressing of one part of a mechanical system (one gear in a mesh, bearing raceways) against a rigid, properly sized ceramic or tool steel that applies a load, an alternative embodiment could utilize the superelastic parts together and alter the conditions such that the heavy load contacting points move about during the treatment. For a gear set, two superelastic gears could be smoothly loaded against one another during rotation while gradually changing the distance between their respective rotational axes to achieve high stress on the teeth surfaces over a broad area. Similarly, a ball bearing made entirely from superelastic materials could be operated under a heavy radial load while altering the axial load thusly moving the contact path of the balls over a larger region of the raceway. These alternate embodiments are not as controlled or precise as the method proposed earlier in this document but they are simpler and may be sufficient in certain circumstances.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A method for conferring full superelastic properties to a contacting surface of a mechanical component constructed of a superelastic material prior to service, comprising:

applying a compressive load to the contacting surface of the mechanical component;

removing the compressive load from the contacting surface whereby substantially all load strain is recoverable after applying and removing of subsequent compressive loads;

selecting the mechanical component to be inner and outer ball bearing raceway tracks forming the contacting surface;

applying the compressive load to the bearing raceway tracks with a plurality of balls; and selecting the plurality of balls to have a diameter larger than the diameter of balls to be used in service.

2. The method of claim 1 wherein applying the compressive load to the bearing raceway tracks with a plurality of balls rolling over the raceway tracks.

3. The method of claim 2 wherein applying a compressive load to the bearing raceway tracks includes applying axial and radial loading to the bearing raceway tracks.

4. The method of claim 1 wherein the component was processed through heat treatment prior to applying the compressive load.

5. The method of claim 1 wherein the component was processed substantially to its final desired dimensions prior to applying the compressive load.

6. The method of claim 1 including applying a compressive load to the contacting surface of the mechanical component in excess of a design load.

7. The method of claim 1 including applying a lubricant to the contacting surface prior to applying the compressive load.

8. The method of claim 1 including uniformly applying the compressive load.

9. The method of claim 1 including applying the compressive load with a material that is harder than the superelastic material.

* * * * *